United States Patent [19]

Harbeke

[11] Patent Number: 4,882,886

[45] **Date of Patent: * Nov. 28, 1989**

[54] AUTOMATICALLY-RELEASABLE PIPE ATTACHMENT DEVICE

[76] Inventor: Gerold J. Harbeke, 2807 South Military Trail, West Palm Beach, Fla. 33415

[ * ] Notice: The portion of the term of this patent subsequent to Feb. 17, 2004 has been disclaimed.

[21] Appl. No.: 92,337

[22] Filed: Sep. 1, 1987

[51] Int. Cl.[4] ..... E04F 17/00; F16L 3/00

[52] U.S. Cl. ..... 52/232; 52/220; 52/576; 52/699; 249/39; 249/91; 249/177; 249/207; 285/64

[58] Field of Search ..... 249/39, 43, 83, 91, 249/93, 94, 96, 177, 186, 207; 52/220, 221, 576, 577, 699, 701, 232; 285/64, 56

[56] References Cited

U.S. PATENT DOCUMENTS

| | | | |
|---|---|---|---|
| 1,603,245 | 3/1926 | Pederson | 52/221 |
| 1,908,796 | 5/1933 | Suchan | 249/177 |
| 3,831,335 | 8/1974 | Ary | 52/221 |
| 4,118,906 | 10/1978 | Preuninger et al. | 52/699 |
| 4,261,598 | 4/1981 | Cornwall | 285/56 |
| 4,453,354 | 6/1984 | Harbeke | 52/220 |
| 4,619,087 | 10/1986 | Harbeke | 52/221 |
| 4,619,471 | 10/1986 | Harbeke | 285/158 |
| 4,642,956 | 2/1987 | Harbeke | 52/232 |

FOREIGN PATENT DOCUMENTS

| | | | |
|---|---|---|---|
| 1170299 | 5/1964 | Fed. Rep. of Germany | 249/177 |
| 2615428 | 10/1977 | Fed. Rep. of Germany . | |
| 2299478 | 8/1976 | France | 52/699 |

*Primary Examiner*—James C. Housel

*Attorney, Agent, or Firm*—Griffin, Branigan & Butler

[57] ABSTRACT

A pipe attachment device (12, 52) for attaching a pipe (16, 54) to a concrete form wall (14) includes an axially extending wall (12, 54) and a floor (24, 58) extending laterally from a first end of the axially extending wall. The floor is affixed to the concrete form and the pipe to be held in place on the form is pressed on the axially extending wall. The pipe is held thereon by the friction of a force fit. After concrete is poured into the form wall and allowed to cure, the pipe attachment device is removed with the concrete form wall while the pipe is allowed to stay embedded in the wall. A separate riser (20) is adhered to the outer surface of a standard pipe (16) to prevent it from sliding out of the concrete once the form is removed. A special pipe coupler (54) can be used with a male pipe attachment device having a built in shoulder (68) and riser (64). Intumescent cuffs (18, 56) can be used with either the standard pipe or the special pipe coupler.

2 Claims, 3 Drawing Sheets

AUTOMATICALLY-RELEASABLE PIPE ATTACHMENT DEVICE

BACKGROUND OF THE INVENTION

This invention relates generally to the art of pipe networks for buildings and especially to apparatus and methods for embedding pipes in floors and walls and making fire-retardant pipe networks.

Until relatively recently, pipe networks were normally extended through floors of buildings by forming holes in the floors—e.g. by using void-forming devices during the "pouring" of the concrete floors, by knocking-out holes, by boring such holes after the floors had been formed, etc.—and thereafter extending pipes through these holes. Normally, the holes were made to be bigger than the pipes to ensure that one could easily extend pipes through the holes. Thereafter, it was necessary for workmen to fill the spaces between the pipes and the floors with cement or some other substance to meet fire codes which generally do not allowed holes in floors.

There have been a number of patents and other documents published, such as German Offenlegungsshrift 2,615,428, U.S. Pat. No. 4,453,354 to Harbeke, and U.S. Pat. No. 4,261,598 to Cornwall disclosing the concept of cementing pipe specialized coupling joints into floors when the floors are formed (sometimes called "cast-in couplings") and thereafter mating external pipes to opposite ends of the thusly embedded coupling joints. Difficulties with specialized pipe-coupling joints are that they are relatively expensive, they are sometimes difficult to cut to proper lengths for various concrete-floor thicknesses, and most of them do not prevent the spread of fire from a lower story to a higher story. It is an object of this invention to provide a device and method which allows one to construct an inexpensive "cast-in" coupling to be a proper length for a desired concrete-floor thickness which retards the spread of fire between stories. In this regard, it is an object of this invention to allow one to construct a cast-in coupler of standard pipe.

With regard to the "spread of fire", a major problem which still exists for plastic pipe-coupling joints which are embedded in floors is that when there is a fire, the fire melts external plastic pipes and then passes through embedded pipe coupling joints to the next higher floor. In other words, the embedded, or "cast-in" pipe coupling joints themselves serve as ventilation holes for fires. It has been suggested, and some fire codes require, that intumescent material surround plastic pipes where they pass through floor barriers. Upon being heated by a fire in the story below, such intumescent material swells, thereby compressing the plastic pipe closed at the floor barrier and preventing the fire from spreading through the floor barrier. Some of the specialized prior-art embedded pipe coupling joints have flanges at their bottom ends which are used to attach coupling joints to floor cement forms. Once the forms are removed these flanges serve as barriers to prevent heat from rising along outside surfaces of the joints to contact intumescent material wrapped thereabout and thereby delay the heating of the intumescent material and its swelling. Thus, it is a further object of this invention to provide a device and method for preparing an embedded pipe surrounded by intumescent material which is open to atmosphere from the story below so that it can quickly receive heat therefrom.

It has been suggested to attach cast-in pipe couplings to forms by means of separate attachment devices which must be removed before the forms are removed. Such devices are described in U.S. Pat. Nos. 4,619,087 and 4,642,956 to Gerold Harbeke. Other suggested devices hold pipes to forms by means of nails, screws and the like which, when the forms are removed, rip out of the form or the pipe. Such devices are described in U.S. Pat. No. 4,261,598 to Cornwall and in U.S. Pat. No. 4,619,471 to Harbeke. Such devices sometimes harm the form when they are removed and/or harm the pipe which must remain in the cement. A problem with both of these types of pipe attachment devices is that once the form is removed they are no longer properly attached to the form and cannot again be used to hold other pipes to the form for casting additional floors of a building. It is an object of this invention to provide a separate pipe attachment device and method which does not have to be removed from a form prior to the form being removed from cured concrete and which does not damage either the form or the pipe upon removal of the form from the cured concrete. Further, it is an object of this invention to provide a pipe attachment device and method which remains attached to the form when the form is removed, and is thereby a part of the form so that it can again be used for attaching pipes to the form when the form is used for casting additional floors.

It is yet another object of this invention to provide a pipe attachment device and method which can be used for making fire-retardant fluid couplings which act quickly enough to prevent a fire from spreading to the next higher story through a bore of the fluid coupling.

It is yet another object of this invention to provide a pipe attachment device for attaching pipes to concrete forms which is inexpensive to manufacture and use and which provides a great deal of flexibility in creating cast-in pipes.

SUMMARY

According to principles of this invention, a pipe attachment apparatus and method involve a pipe attachment device which is fixedly attached to a form but is automatically releasably attached to a pipe to be held in the form. A floor of the pipe attachment device is attached to the form while an axially extending wall has a radially-directed surface which is sufficiently axially long and properly shaped and sized to tightly fit the surface of a pipe about its periphery such that the pipe can be force fitted onto the device to be tightly held thereby for casting concrete about the pipe. After the concrete has cured the form can be removed while automatically leaving the attaching device affixed to the form. These attaching devices can be of a female or a male type and can be used with standard pipe, special pipe couplers, intumescent material cuffs, and separate riser rings to provide fire-retardant cast-in couplings.

BRIEF DESCRIPTION OF THE DRAWINGS

The foregoing and other objects, features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
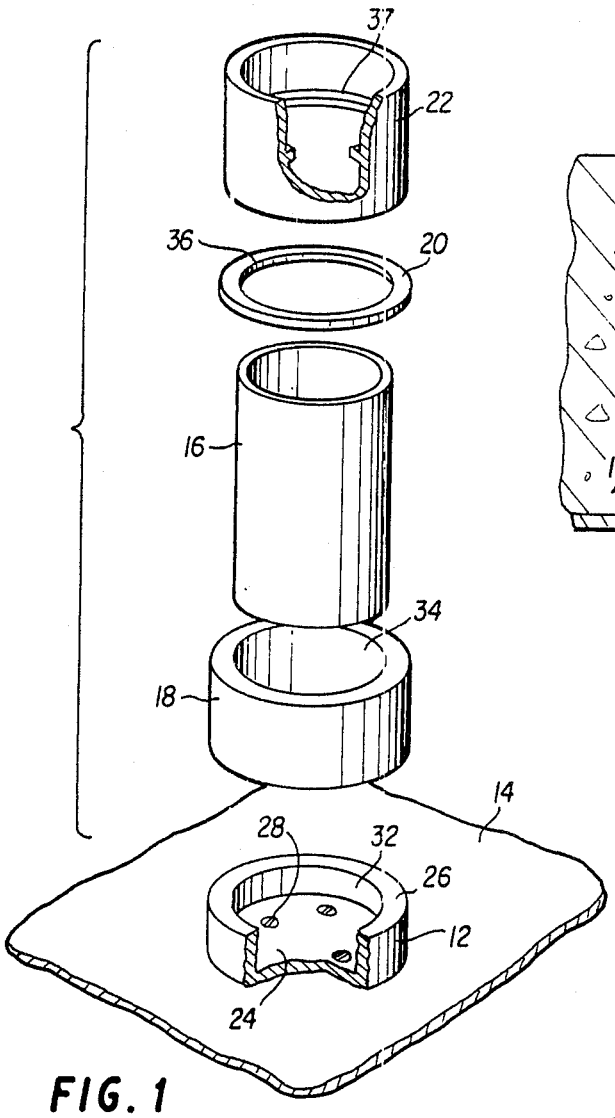
FIG. 1 is an exploded, isometric, partially cutaway, view of a pipe attachment apparatus of this invention attached to a form, along with a pipe stub to be attached thereto, an intumescent cuff, a separate riser, and a standard coupling.
Figure 2:
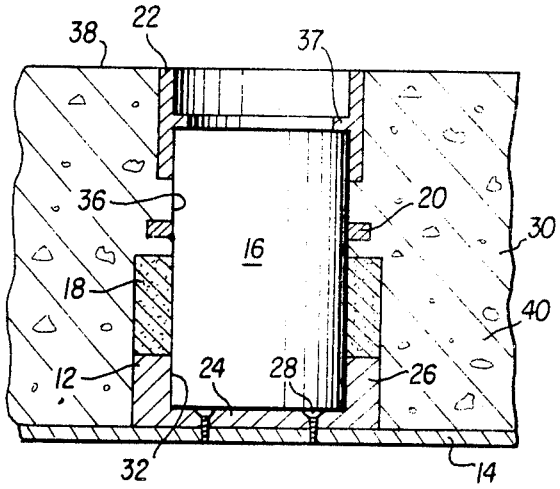
FIG. 2 is a side partially sectional, view of the structure of FIG. 1 shown cast in concrete.
Figure 3:
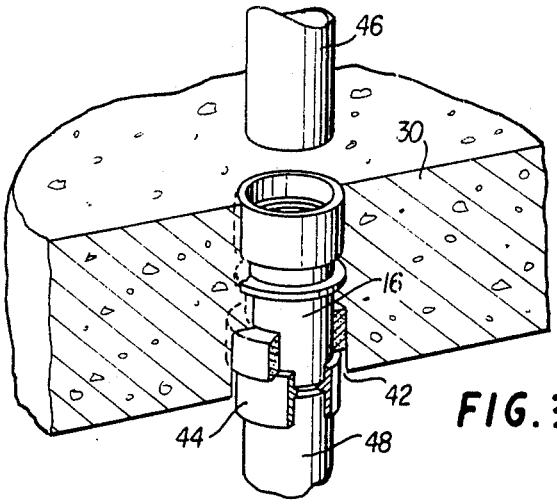
FIG. 3 is an isometric, partially sectional, partially exploded, view of the structure of FIGS. 1 and 2 with the form and pipe attachment device removed, an extra standard coupling attached to the lower end of the pipe stub, and pipes attached to the couplings at opposite ends of the pipe stub.

The pipe attachment apparatus 10 of the FIGS. 1–3 embodiment includes a female-type pipe attachment device 12 attached to a concrete form wall 14, a pipe stub 16 cut from standard plastic pipe, an intumescent cuff 18, a separate riser ring 20, and a first standard pipe coupler 22.

The female-type pipe attachment device 12 is formed of a one-piece mold of PVC or ABS type polymer plastic to have a relatively thin floor wall 24 and a thicker side wall 26. In this respect, the floor wall 24 is ¼ inch or less thick while the side wall 26 is between ¼ inch and ½ inch. The side wall 26 extends axially for a distance of around 1 inch or more. The floor wall 24 has holes therein through which nails, screws, or the like 28 can extend to fasten the female-type pipe attachment device 12 to the concrete form wall 14. The female-type pipe attachment device 12 can also be welded or otherwise adhered to the concrete form wall 14.

The pipe stub 16 is cut from standard pipe to an appropriate length for a particular thickness of a concrete barrier 30 to be cast. If the pipe stub 16 is cut, for example, from two inch pipe (meaning a two inch internal diameter) it will have an external diameter of around 2 ⅜ inches. In this case, the female-type pipe attachment device 12 will be constructed of a size such that its side wall 26 forms a cylindrically-shaped space 32 having a diameter which is also about 2 ⅜ inches so that it tightly fits the outer surface of the pipe stub 16 and so that the pipe stub 16 can be pressed completely down into the cylindrically-shaped space 32.

Similarly, the intumescent cuff 18 forms a cylindrically-shaped opening 34 therein in which the pipe stub 16 snugly fits. The intumescent cuff 18 is formed of a fire barrier material which swells when it becomes hot. Such intumescent materials are manufactured by 3M of St. Paul, Minnesota, however, other materials might also be available.

The separate riser ring 20 is also molded of PVC or ABS polymer plastics to have a circular opening 36 therein which fits the outer surface of the pipe stub 16 relatively snugly. The separate riser ring is slid on the pipe stub 16 and adhered thereto by a dissolving type pipe adhesive at a location shown in FIG. 2.

The first standard female/female pipe coupler 22 is an off-the-shelf item molded to have an internal shoulder 37 against which pipes inserted from opposite ends thereof come into contact.

Figure 7:
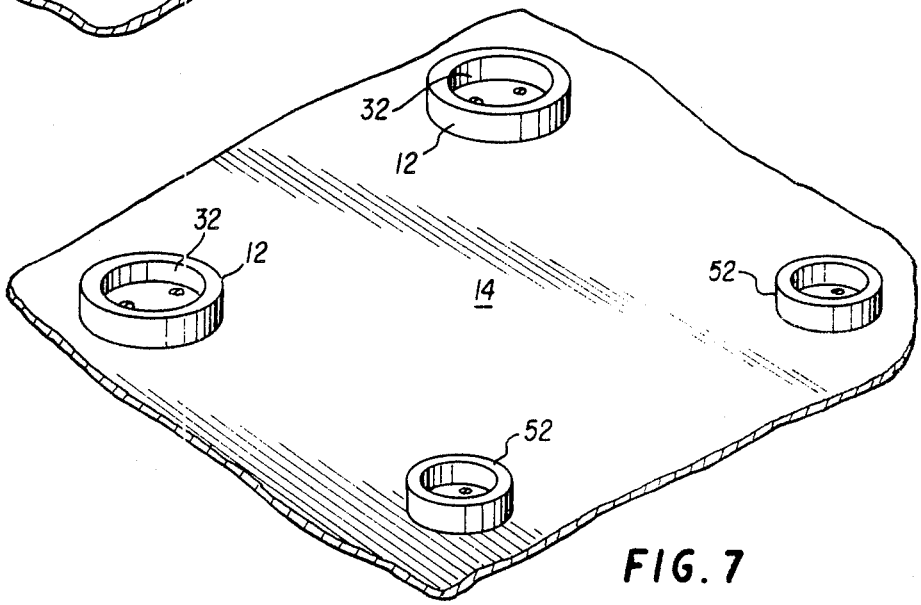
FIG. 7 is an isometric view of both female and male type attachment devices of the FIGS. 1 and 4 embodiments mounted on a form wall.

In use, after a concrete form 14 is in position a worker, and the worker does not have to be a plumber, determines the locations at which it is desired to have a pipe extend through a concrete barrier 30 to be cast and he attaches the female-type pipe attachment devices 12 to the concrete form wall 14 at those locations using screws, nails, welding, or the like so that the form wall now looks like the structure shown in FIG. 7. Essentially, these female-type attachment devices become part of the concrete form wall 14 until they are removed therefrom. Thereafter, another worker, most likely a plumber, cuts pipe stubs 16 to be lengths such that when a first end of each of them is inserted into its respective cylindrically-shaped space 32 of a female-type attachment device 12 and the female/female standard pipe coupler 22 is placed on a second end thereof, as depicted in FIG. 2, the female/female standard pipe coupler extends approximately to a top surface 38 of the concrete barrier 30 to be cast. The plumber adheres the separate riser ring 20 to the outer surface of the pipe stub 16, adheres the female/female standard pipe coupler 22 to the second end of the pipe stub 16, and encircles the pipe stub 16 with the intumescent cuff 18. The plumber then inserts the first end of the pipe stub 16 into the cylindrically-shaped space 32 of the female-type pipe attachment device 12 where it is tightly held by the friction of a force fit as shown in FIG. 2.

Concrete 40 is then poured into the concrete form 14 and allowed to cure thereby becoming a concrete barrier 30. The concrete form wall 14 is then removed and with it is automatically removed the female-type pipe attachment device 12 which has become a part of the concrete form. The pipe stub 16 is prevented from leaving the concrete barrier 30 when the concrete form wall 14 is pulled away by the riser ring 20 which is adhered thereto. Once the female-type pipe attachment device 12 is pulled away from the pipe stub 16, the first end thereof is surrounded by a space 42 (FIG. 3) in the concrete left by the side wall 26 of the female-type pipe attachment device 12. This allows a second standard female/female pipe coupler 44 to be attached to the first end of the pipe stub 16 as is depicted in FIG. 3. Thereafter, first and second pipes 46 and 48 are inserted into the first and second standard female/female pipe couplers 22 and 44 so that they are then coupled to the pipe stub 16 to provide liquid flow through the concrete barrier 30. The space 42 left in the concrete barrier 30 by the side wall 26 of the female-type pipe attachment device 12 is sufficiently large that it allows air from below the concrete barrier to have access to the intumescent cuff 18. Thus, if there is a fire below the concrete barrier 30, heat will rise in the space 42, contacting the intumescent cuff 18, causing it to swell, thereby closing off the pipe stub 16 and preventing the fire from spreading to the next higher floor.

Figure 4:
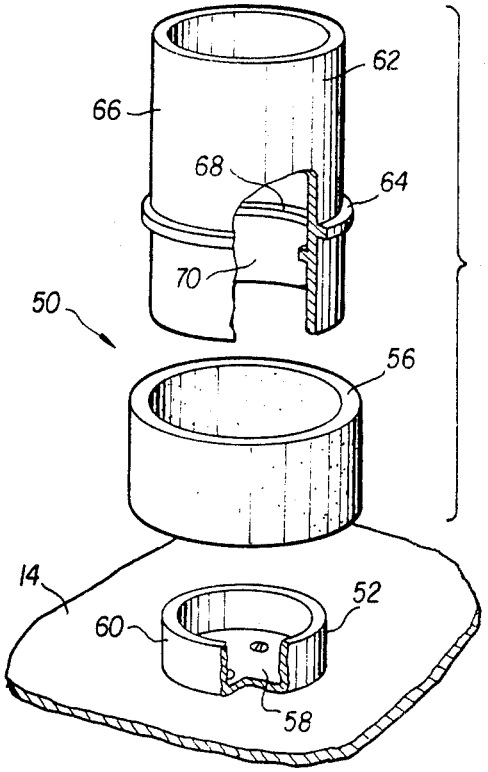
FIG. 4 is an isometric exploded view of another embodiment of this invention employing a specialized pipe coupling and a male-type attachment device attached to a form wall.
Figure 5:
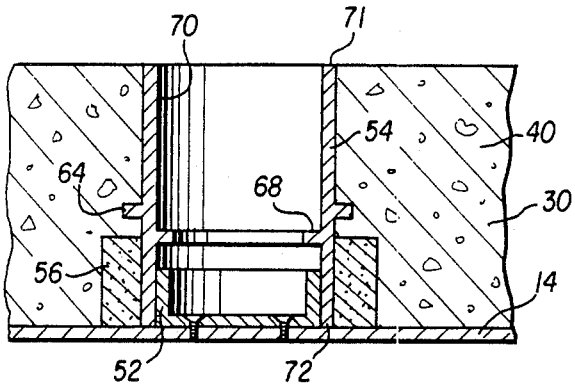
FIG. 5 is a cross sectional view of the apparatus depicted in FIG. 4.
Figure 6:
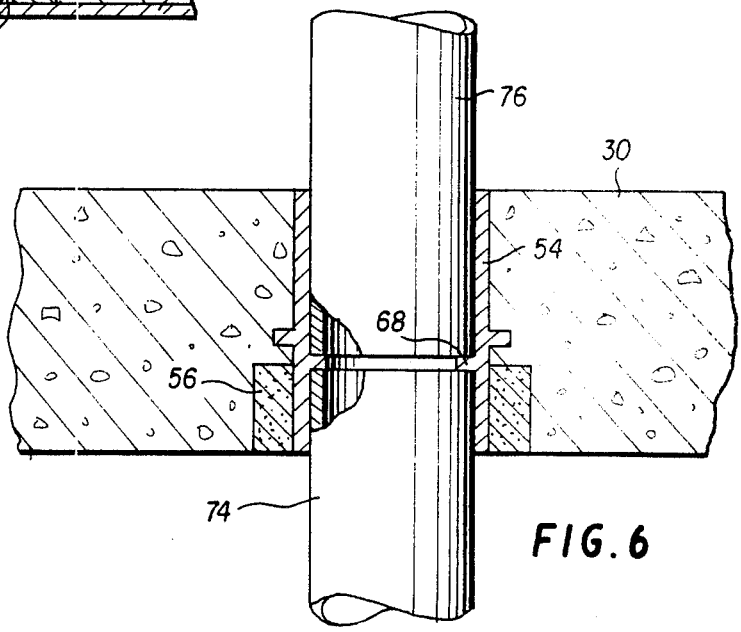
FIG. 6 is a side, partially sectional, partially cutaway, view of the structure of FIG. 5 with the form wall and the attached male-type attachment device being removed but with two pipes being mounted in the specialized coupling from opposite ends thereof.

Turning next to the pipe attachment apparatus 50 of the FIGS. 4–6 embodiment, this apparatus includes a male-type pipe attachment device 52 which is attached to the concrete form wall 14. Also included with this apparatus are a pipe coupler 54 and an intumescent cuff 56.

The male-type pipe attachment device 52 is also molded of ABS or PVC polymer plastic to have a floor wall 58 and a side-wall 60. In this case, the floor wall 58 and the side-wall 60 can have a thickness of around ¼ inch. The floor wall 58 has holes therein through which nails, screws, or the like attach it to the concrete form wall 14, or, it could be welded, or otherwise adhered thereto.

The pipe coupler is a special cast and is not a standard off-the-shelf item in the preferred embodiment. In this respect, the special pipe coupler 54 includes a tubular wall 62 in the same manner of a pipe but has cast integrally therewith a riser ring 64 on the outer surface 66 thereof and a ring shoulder 68 on an inner surface 70 thereof.

The intumescent cuff 56 is similar to the intumescent cuff 18 of the FIGS. 1–3 embodiment, however, it has a larger internal diameter in order to fit the special pipe coupler 54. In this respect, if the special pipe coupler 54 is o be used for 3 inch pipe, the internal diameter thereof is around 3 ½ inches and the external diameter thereof is around 4 inches. The external diameter of the male-type pipe attachment device 52 is also 3 ½ inches (the same as that of standard pipe). In the case of a 3 inch pipe, as opposed to a 2 inch pipe, it is necessary that the axial length of the side-wall 60 be longer so that it is at least 1 ½ inches. The increased length is necessary with increased diameter to insure that proper support is given to the special pipe coupler 54 against lateral shoving at its upper end which might cause it to rotate off of the male-type pipe attachment device 52. As can been seen in FIG. 5, the male-type pipe attachment device 52 fits tightly into a bottom end 72 of the special pipe coupler 54.

In operation of the FIGS. 4–6 embodiment, a worker, not necessarily a plumber, determines those locations on the concrete form 14 at which a pipe is to extend through the concrete barrier 30 and he attaches male-type pipe attachment devices 52 at those locations on the concrete form wall 14 as depicted in FIG. 7. Thereafter, another worker, most likely a plumber, cuts portions of the upper ends 71 of the special pipe couplers 54 to make them a length which is approximately the same as the thickness of the concrete barrier 30 to be poured. It should be noted that the riser ring 64 and the ring shoulder 68 are closer to the lower end 72 of the special pipe coupler 54 so that they will not be disturbed by cutting away on the upper end 71 of the special pipe coupler 54. Thereafter, the worker places the intumescent cuff 56 on each special pipe coupler 54 and forces the lower end 72 of each special pipe coupler 54 down onto a respective male-type pipe attachment device 52. The special pipe coupler 54 is held on the male-type attachment device by means of friction between these two members. Thereafter, concrete 40 is poured into the concrete form wall 14 and allowed to cure. Once the concrete has cured, the concrete form wall 14 is pulled away along with the male-type pipe attachment device 52. The special pipe coupler 54 is prevented from being pulled out of the concrete barrier 30 by its integral riser ring 64. In this embodiment, the intumescent cuff 56 is immediately adjacent air below the concrete barrier 30 and so is immediately contacted by any heat below the barrier 30. As can be seen in FIG. 6, first and second pipes 74 and 76 are inserted into the special pipe coupler 54 from below and above the barrier 30 so as to form a liquid passage through the barrier 30. Should a fire occur below the concrete barrier 30, heat will contact the intumescent cuff 56 and it will swell, thereby closing of the passage formed by the special pipe coupler 54 and the pipes mounted therein.

It can be appreciated by those skilled in the art that the pipe attachment apparatus and method described herein allow a form to be modified to be repeatedly used for holding cast-in pipes when used for casting different floors of a building, but yet allow the form to be easily changed back to its original state for use on another building. Also, the apparatus and method described herein allow the placement of cast-in pipes to be carried out by those other than plumbers. Also, this apparatus and method provides fire proof cast-in couplings which are highly reliable. Still further, the apparatus and method of this invention involve parts which are inexpensive to manufacture and use. Still further, the pipe attachment devices are used to hold pipes and couplings which do not have any type of attachment devices thereon to cooperate therewith.

While the invention has been particularly shown and described with reference to preferred embodiments, it will be understood by those skilled in the art that various changes in form and detail may be made therein without departing from the spirit and scope of the invention. For example, it would be possible to use caps, or covers, at the upper ends of the standard pipe coupler 22 and the special pipe coupler 54 to prevent concrete from entering the bores thereof during a pour. Alternately, in the FIG. 1 embodiment, one could cut the pipe stub 16 to be sufficiently long that its upper end extends almost to the top surface 38 of the barrier 30 and then place a cap thereon which leaves a space at the outer surface of the pipe stub 16 so that a standard coupler can be attached at its upper end once the concrete 40 has hardened. Also, it should be understood that the special pipe coupler 54 could be sold with an intumescent cuff 56 already mounted thereon so that the worker who installs the special pipe coupler 54 need not place the intumescent cuff 18 on the coupler. In addition, although the female and male pipe attachment devices 12 and 52 are depicted as having the shapes of cups, it would be possible to make them in other shapes. For example, they could each comprise a floor having shafts arising therefrom positioned to define a wall of separated shafts. It would also be possible to make the floor wall in the form of a laterally extending flange which is outside of the side wall. Further, the male-type pipe attachment device 52 could be solid, rather than being hollow on the inside, however, it might be more difficult to nail or screw it to a form in that case. Also, if the male-type pipe attachment device 52 were solid, it would not be as resilient for allowing the special coupler 54 to be slid thereon.

The embodiments of the invention in which an exclusive property or privilege are claimed are defined as follows:

1. Pipe attachment apparatus for producing a fire-spread prevention pipe coupler in a concrete form wall, said apparatus including:

an elongated, cylindrical, female-at-both-ends, pipe coupler having a pipe-coupler wall with external and internal radially outwardly and inwardly directed surfaces for defining an axis of elongation, first and second ends, and an internal shoulder on the inwardly directed surface for contacting a male end of a pipe to be coupled with said pipe coupler;

a pipe-attachment device comprising an axially-extending wall means for extending away from a concrete form wall, said axially-extending wall means defining a radially outwardly directed surface for tightly contacting said internal radially inwardly directed surface of said pipe-coupler wall and holding thereto by friction, but allowing said pipe coupler to be removed therefrom if sufficient axial force is applied thereto, said pipe-attachment device further comprising a floor means at a first end of said axially-extending wall means for being attached to said concrete form wall to thereby support said axially-extending wall means with a second end thereof extending away from said form wall; and an intumescent collar wrapped about the external radially outwardly directed surface of said pipe coupler at said first end for expanding in response to heat for closing off said first end of said pipe coupler;

said radially outwardly directed surface of said pipe attachment device being sufficiently axially long and shaped and sized to tightly fit said internal radially inwardly directed surface of said pipe coupler such that said floor means of said pipe attachment device can be affixed to said form wall to become a part thereof and thereafter said first end of said pipe coupler can be pressed down onto said pipe attaching device to be held in place on said form wall during the pouring of concrete into said form wall and after the concrete is cured, the form wall can be removed while leaving the attachment device affixed to the form wall with an end of said intumescent collar being exposed.

2. A pipe attachment apparatus as in claim 1, wherein said attachment device has a hollow cylindrical shape.

* * * * *